US011006749B2

(12) United States Patent
Anderson et al.

(10) Patent No.: US 11,006,749 B2
(45) Date of Patent: May 18, 2021

(54) SYSTEMS, BRACKETS, AND METHODS FOR MOUNTING STORAGE STRUCTURES TO OFFICE WORK SURFACES

(71) Applicant: HNI Technologies Inc., Muscatine, IA (US)

(72) Inventors: Jared Anderson, Muscatine, IA (US); Lance Allgood, Iowa City, IA (US); Ryan McCarthy, Davenport, IA (US)

( * ) Notice: Subject to any disclaimer, the term of this patent is extended or adjusted under 35 U.S.C. 154(b) by 0 days.

(21) Appl. No.: 15/934,550

(22) Filed: Mar. 23, 2018

(65) Prior Publication Data

US 2019/0290002 A1 Sep. 26, 2019

(51) Int. Cl.

| | |
|---|---|
| ***A47B 96/06*** | (2006.01) |
| ***A47B 83/00*** | (2006.01) |
| *B42F 15/00* | (2006.01) |

(52) U.S. Cl.

CPC ..... *A47B 96/06* (2013.01); *A47B 83/001* (2013.01); *A47B 2200/09* (2013.01); *A47B 2220/0036* (2013.01); *B42F 15/0094* (2013.01)

(58) Field of Classification Search

USPC ..... 248/205.1

See application file for complete search history.

(56) References Cited

U.S. PATENT DOCUMENTS

| | | | | |
|---|---|---|---|---|
| 1,471,712 A | | 10/1923 | Sohnle | |
| 2,729,529 A | * | 1/1956 | Nordmark | A47B 39/00 312/108 |
| 3,104,138 A | | 9/1963 | Renaud | |
| 3,337,172 A | * | 8/1967 | Jackson | A47B 96/068 248/222.51 |
| 3,346,311 A | | 10/1967 | Bears | |
| 3,708,709 A | | 1/1973 | Morrison et al. | |
| 3,809,449 A | | 5/1974 | Beaver | |
| 3,857,622 A | | 12/1974 | Hockenberry et al. | |
| 3,862,789 A | | 1/1975 | Korell | |
| 3,909,091 A | | 9/1975 | Tantillo | |
| 4,101,183 A | * | 7/1978 | McManus | A47B 13/003 108/119 |

(Continued)

FOREIGN PATENT DOCUMENTS

| | | |
|---|---|---|
| DE | 102010050500 B4 | 3/2016 |
| JP | 1150476 S | 8/2002 |

(Continued)

*Primary Examiner* — Monica E Millner

(74) *Attorney, Agent, or Firm* — Faegre Drinker Biddle & Reath LLP

(57) ABSTRACT

A system for mounting to an underside of a work surface of an office furniture structure includes a storage structure and a bracket. The storage structure includes at least one storage chamber and at least one installation feature coupled to the at least one storage chamber. The bracket includes at least one securing feature configured to secure the bracket to the underside of the work surface of the office furniture structure. The bracket further includes at least one installation feature configured to couple the least one installation features of the storage structure. At least one of the storage structure and the bracket includes at least one restraining feature configured to engage the other of the storage structure and the bracket and inhibit the storage structure from being detached from the bracket.

14 Claims, 19 Drawing Sheets

(56) References Cited

U.S. PATENT DOCUMENTS 4,317,416 A * 3/1982 Baum ..... F16B 12/22 108/157.1
4,382,642 A * 5/1983 Burdick ..... A47B 13/003 248/188.7
4,518,208 A 5/1985 Marder
4,588,237 A 5/1986 Marder
4,600,248 A 7/1986 Pflieger
4,660,905 A * 4/1987 Conner ..... A47B 17/00 248/525
4,790,610 A 12/1988 Welch et al.
4,807,764 A * 2/1989 Bellin ..... A47B 77/10 211/118
4,830,440 A * 5/1989 Burch ..... A47B 17/00 108/152
5,048,698 A * 9/1991 Konrad ..... A47F 5/0846 211/103
5,359,752 A 11/1994 Domenig
5,486,042 A 1/1996 Heisler et al.
5,549,376 A 8/1996 Domenig
5,890,325 A * 4/1999 Corcorran ..... A47B 21/00 52/36.1
5,975,658 A 11/1999 Verbeek et al.
D419,333 S 1/2000 Verbeek et al.
6,012,690 A * 1/2000 Cohen ..... A47G 7/044 248/214
D424,328 S 5/2000 Dominik
6,082,838 A 7/2000 Bissu-Palombo
D433,248 S 11/2000 Hellwig et al.
6,253,399 B1 7/2001 Wagner
6,378,255 B1 4/2002 Eich
6,435,461 B1 8/2002 Saylor et al.
6,619,768 B1 9/2003 Northrop et al.
6,817,684 B2 * 11/2004 Cattaneo ..... A47B 21/06 108/50.02
6,948,788 B1 * 9/2005 Tai ..... A47B 88/956 312/204
7,228,977 B2 * 6/2007 Perkins ..... A47B 83/001 211/87.01
7,926,430 B2 * 4/2011 Bakker ..... A47B 21/06 108/25
8,590,714 B1 * 11/2013 Osuna-Valerio ..... E05B 73/00 109/50
9,151,060 B2 * 10/2015 Khongbantabam ..... E04F 13/0862
9,206,827 B2 * 12/2015 Loree ..... A47F 5/0846
9,364,080 B2 * 6/2016 Rutz ..... A47B 21/06
10,258,157 B2 * 4/2019 Wayner ..... A47B 96/1441
10,267,044 B2 * 4/2019 Lamoureux ..... E04F 13/0862
2002/0112411 A1 * 8/2002 Gravel ..... E04B 2/7422 52/36.1
2003/0019165 A1 1/2003 Gallant et al.
2004/0217677 A1 11/2004 Durand et al.
2005/0204646 A1 9/2005 Tupper et al.
2007/0126319 A1 6/2007 Bauer et al.
2008/0036343 A1 2/2008 Wang
2008/0040982 A1 2/2008 Durand et al.
2010/0064543 A1 3/2010 Helot
2011/0315838 A1 * 12/2011 Abell ..... A47B 83/001 248/205.1
2012/0091086 A1 4/2012 Gregory et al.
2012/0273633 A1 * 11/2012 Henriott ..... A47B 96/067 248/205.1
2018/0347609 A1 12/2018 Haley

FOREIGN PATENT DOCUMENTS

JP 1315782 S 11/2007
JP 1372547 S 11/2009

* cited by examiner

SYSTEMS, BRACKETS, AND METHODS FOR MOUNTING STORAGE STRUCTURES TO OFFICE WORK SURFACES

TECHNICAL FIELD

The present disclosure relates to brackets and systems that facilitate mounting storage structures, such as filing cabinets and cubbies, to the underside of work surfaces of office furniture structures, such as desks and tables.

BACKGROUND

Storage structures, such as filing cabinets and cubbies, can be suspended from the underside of work surfaces of office furniture structures, such as desks and tables. However, suspending storage structures in this manner can be cumbersome, and typically a first person holds a storage structure against the underside of a work surface while a second person secures the storage structure to the underside of the work surface (for example, by using fasteners).

SUMMARY

In a first example, a bracket for mounting a storage structure to an underside of a work surface of an office furniture structure includes at least one securing feature that is configured to secure the bracket to the underside of the work surface of the office furniture structure. At least one installation feature is configured to couple the bracket to the storage structure. At least one restraining feature is configured to engage the storage structure and inhibit the storage structure from being detached from the bracket.

In a second example, the at least one restraining feature of the first example includes an arm that is configured to be received in an aperture to inhibit the storage structure from being detached from the bracket.

In a third example, the at least one restraining feature of any of the previous examples includes a leg that is configured to engage and be displaced by the storage structure to inhibit the storage structure from being detached from the bracket.

In a fourth example, the at least one installation feature of any of the previous examples includes a channel that is configured to slidably receive a rail of the storage structure.

In a fifth example, the channel of the fourth example is first channel and the rail is a first rail, and wherein the at least one installation feature further includes a second channel that is configured to slidably receive a second rail of the storage structure.

In a sixth example, the at least one securing feature of any of the previous examples includes a through hole that is configured to receive a mechanical fastener.

In a seventh example, the bracket of any of the previous examples further includes at least one locating feature that is configured to engage an edge of the work surface.

In an eighth example, a system for mounting to an underside of a work surface of an office furniture structure includes a storage structure and a bracket. The storage structure includes at least one storage chamber and at least one installation feature coupled to the at least one storage chamber. The bracket includes at least one securing feature that is configured to secure the bracket to the underside of the work surface of the office furniture structure. The bracket further includes at least one installation feature that is configured to couple the least one installation features of the storage structure. At least one of the storage structure and the bracket includes at least one restraining feature that is configured to engage the other of the storage structure and the bracket and inhibit the storage structure from being detached from the bracket.

In a ninth example, the at least one installation feature of the storage structure of the eighth example includes a rail that is configured to slidably engage the at least one installation feature of the bracket.

In a tenth example, the at least one installation feature of the bracket of the eighth example or the ninth example includes a channel that is configured to slidably receive the rail of the storage structure.

In an eleventh example, the storage structure of the eighth example through the tenth example further includes an aperture, and the at least one restraining feature includes an arm of the bracket, and the arm is configured to be received in the aperture to inhibit the storage structure from being detached from the bracket.

In a twelfth example, the at least one restraining feature of the eight example through the eleventh example further includes a leg of the bracket, and the leg is configured to engage and be displaced by the storage structure to inhibit the storage structure from being detached from the bracket.

In a thirteenth example, the at least one restraining feature of the eight example through the twelfth example includes a leg that is configured to engage and be displaced by the other of the storage structure and the bracket to inhibit the storage structure from being detached from the bracket.

In a fourteenth example, a method for mounting a storage structure to an underside of a work surface of an office furniture structure includes securing a bracket to the underside of the work surface of the office furniture structure, the bracket including at least one restraining feature. The method further includes engaging the storage structure with the bracket and translating the storage structure relative to the bracket such that the at least one restraining feature engages the storage structure and inhibits the storage structure from being detached from the bracket.

In a fifteenth example, the storage structure of the fourteenth example includes at least one aperture, and the at least one restraining feature includes an arm that is received in the at least one aperture to inhibit the storage structure from being detached from the bracket.

In a sixteenth example, the at least one restraining feature of the fourteenth example or the fifteenth example includes a leg that is engaged and displaced by the storage structure to inhibit the storage structure from being detached from the bracket.

In a seventeenth example, the bracket of the fourteenth example through the sixteenth example further includes at least one locating feature, and wherein securing the bracket to the underside of the work surface of the office furniture structure includes engaging the at least one locating feature with an edge of the work surface.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
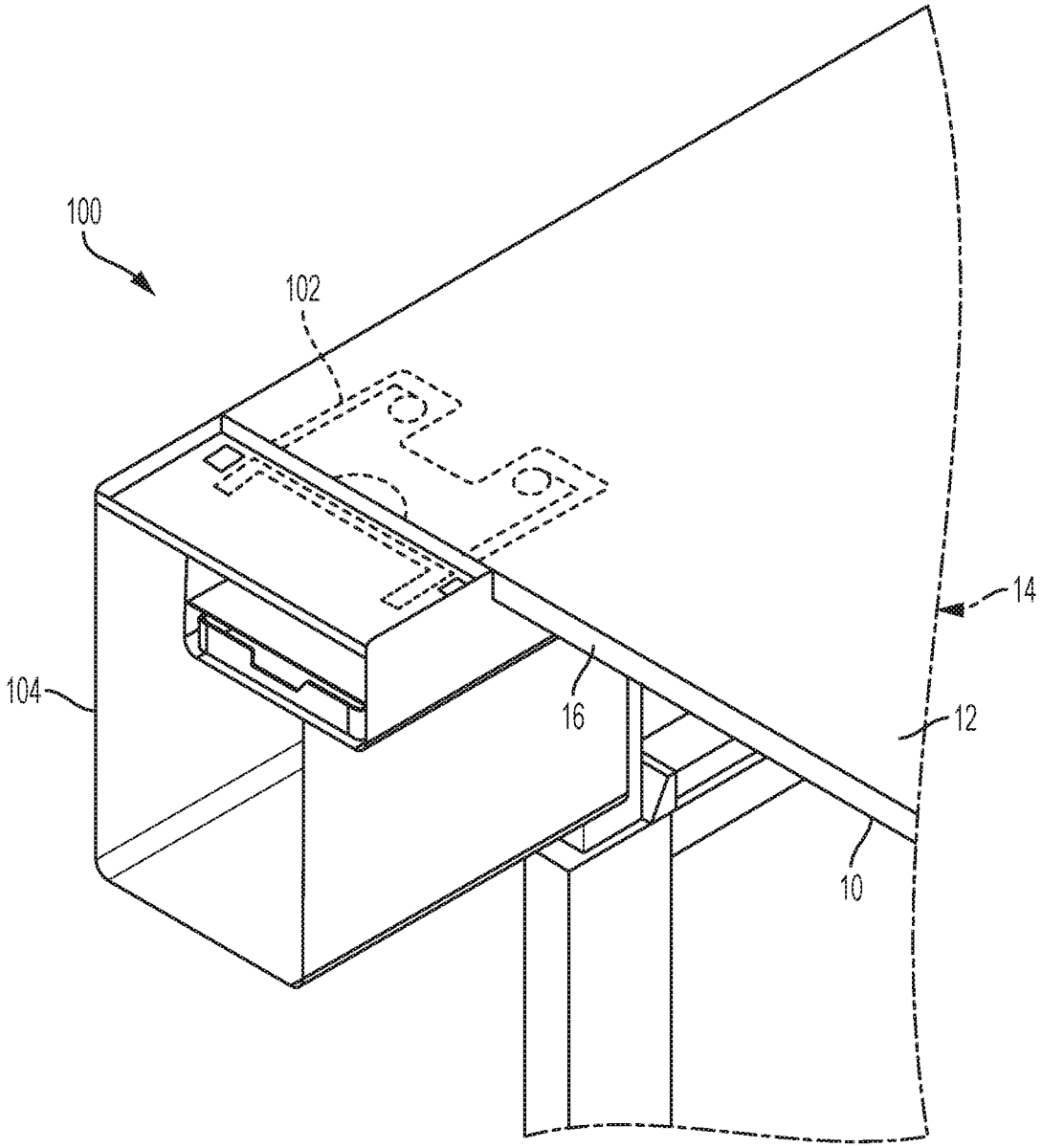
FIG. 1 is a perspective view of a system for mounting to an underside of a work surface of an office furniture structure, according to an embodiment of the present disclosure.
Figure 2A:
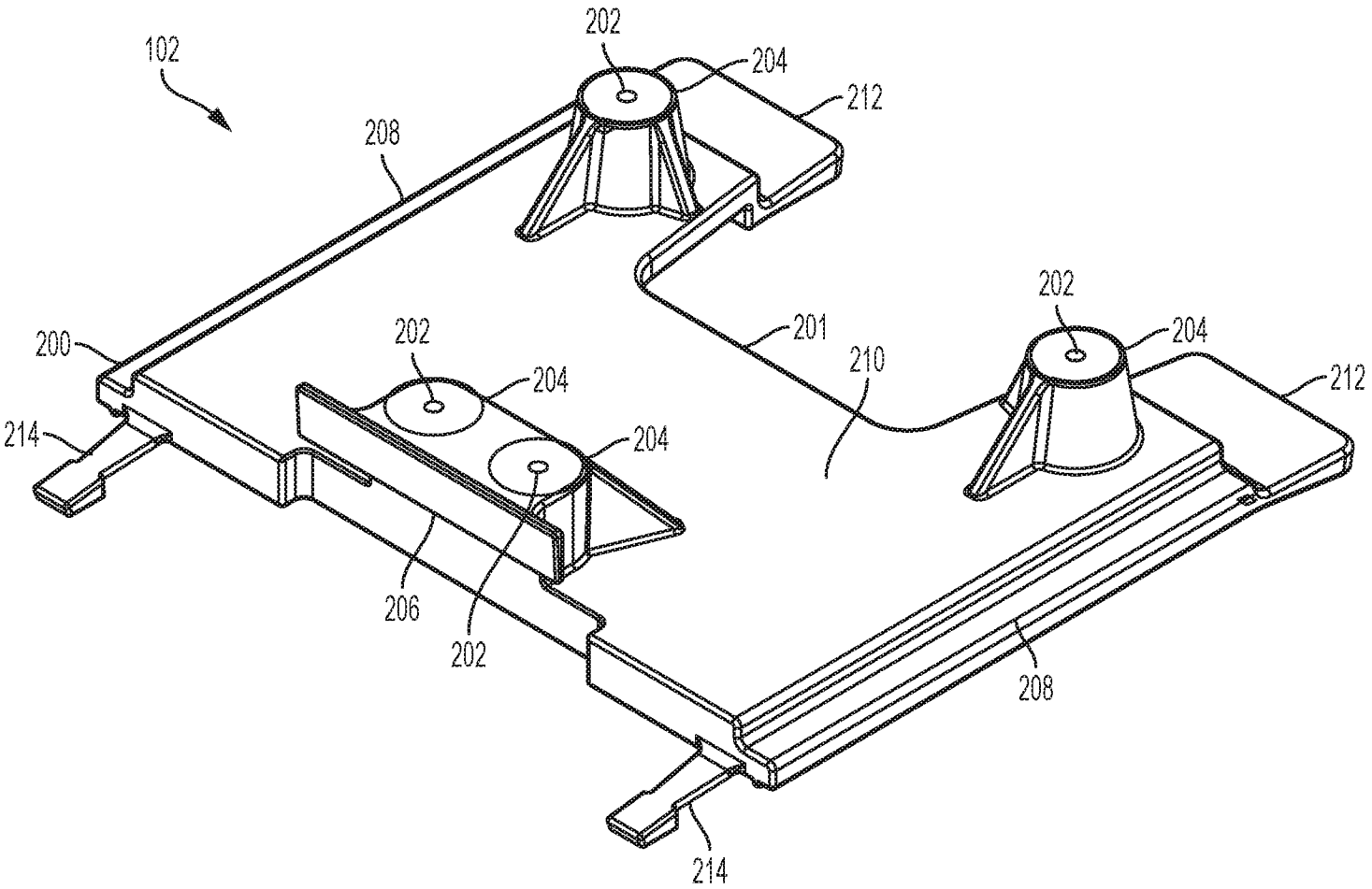
FIG. 2A is a top perspective view of a bracket of the system of FIG. 1.
Figure 2B:
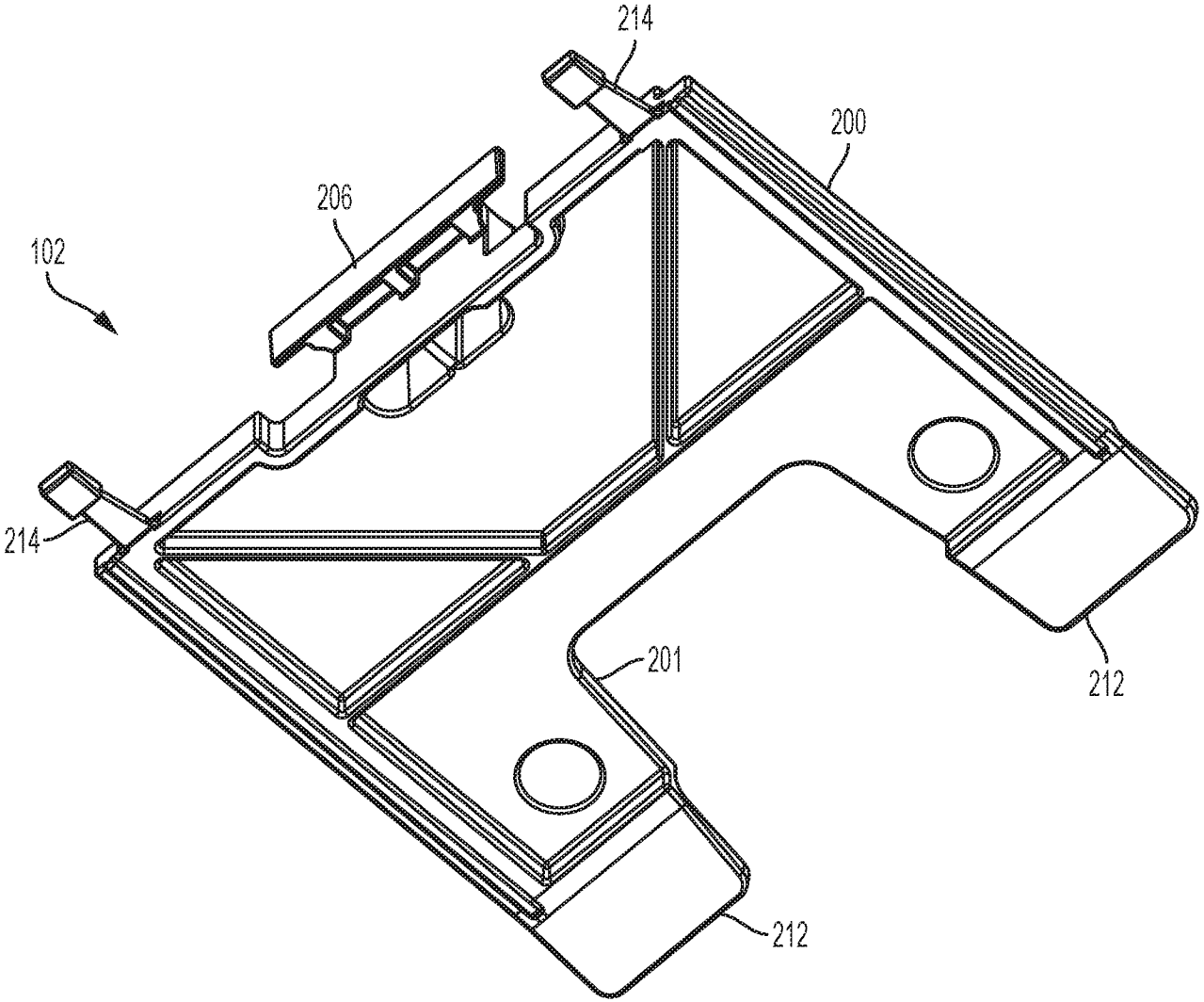
FIG. 2B is a bottom perspective view of the bracket of FIG. 2A.
Figure 2C:
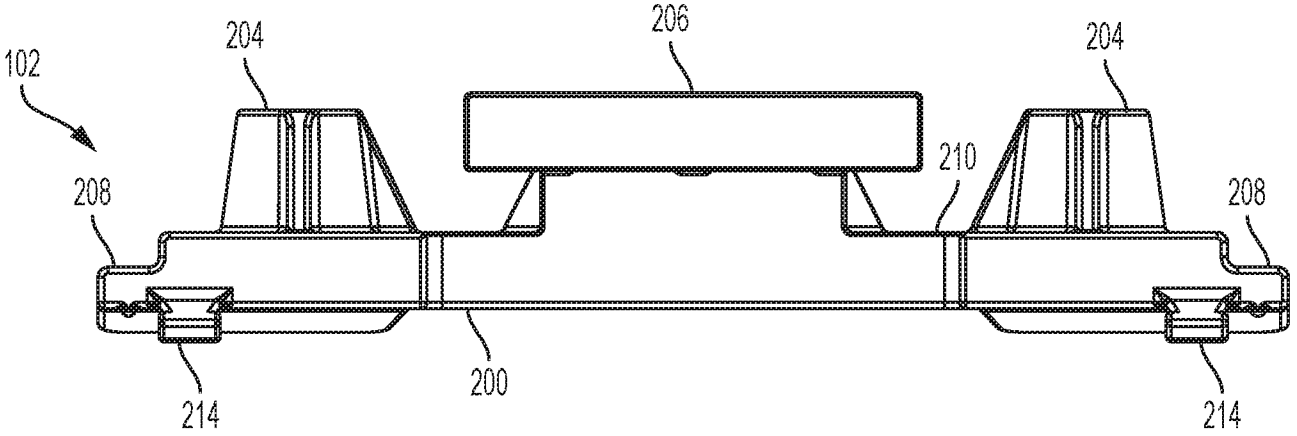
FIG. 2C is a front view of the bracket of FIG. 2A.
Figure 2D:
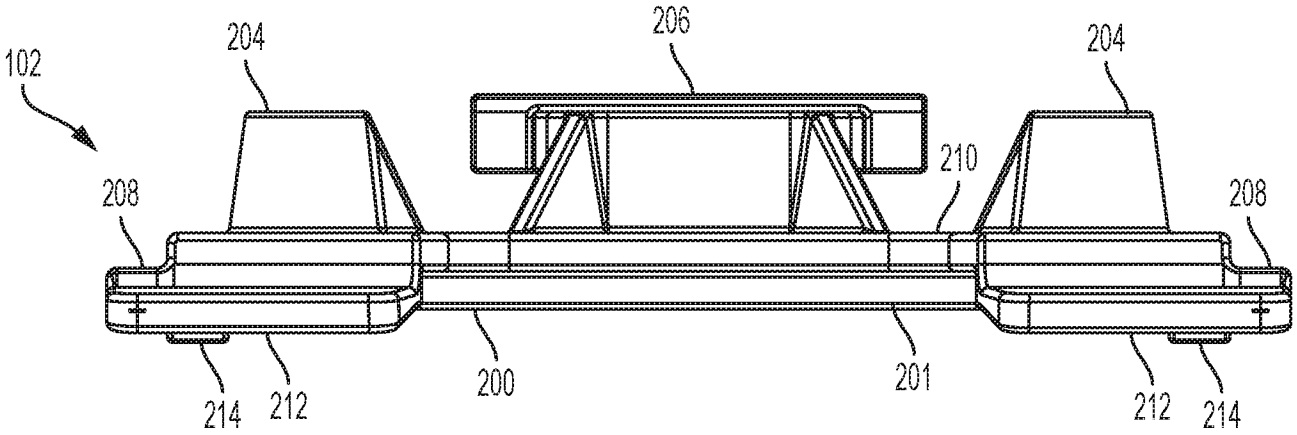
FIG. 2D is a rear view of the bracket of FIG. 2A.
Figure 2E:
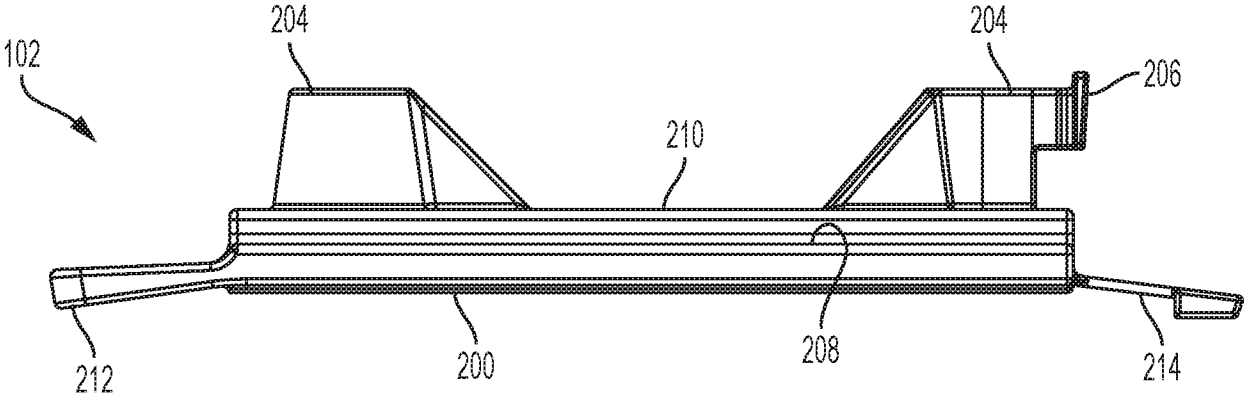
FIG. 2E is a left side view of the bracket of FIG. 2A.
Figure 2F:
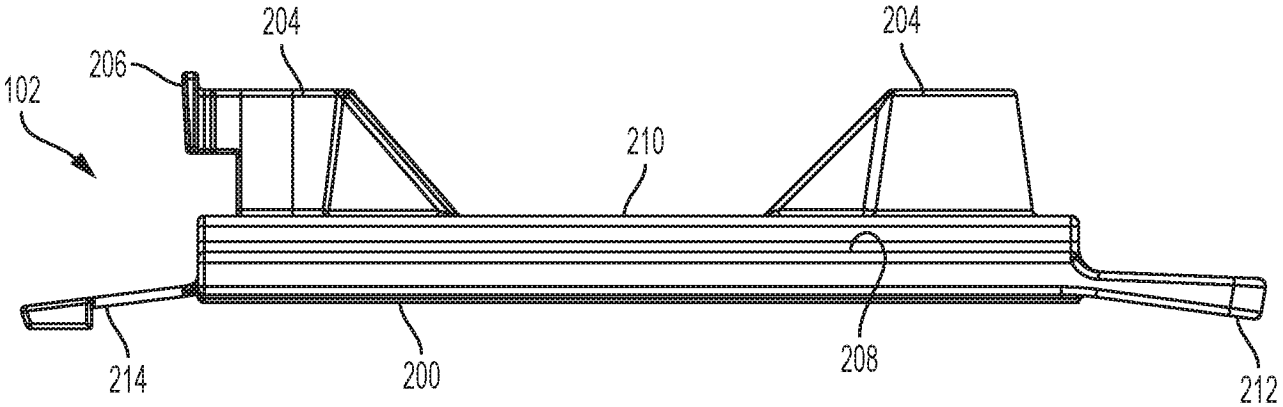
FIG. 2F is a right side view of the bracket of FIG. 2A.
Figure 2G:
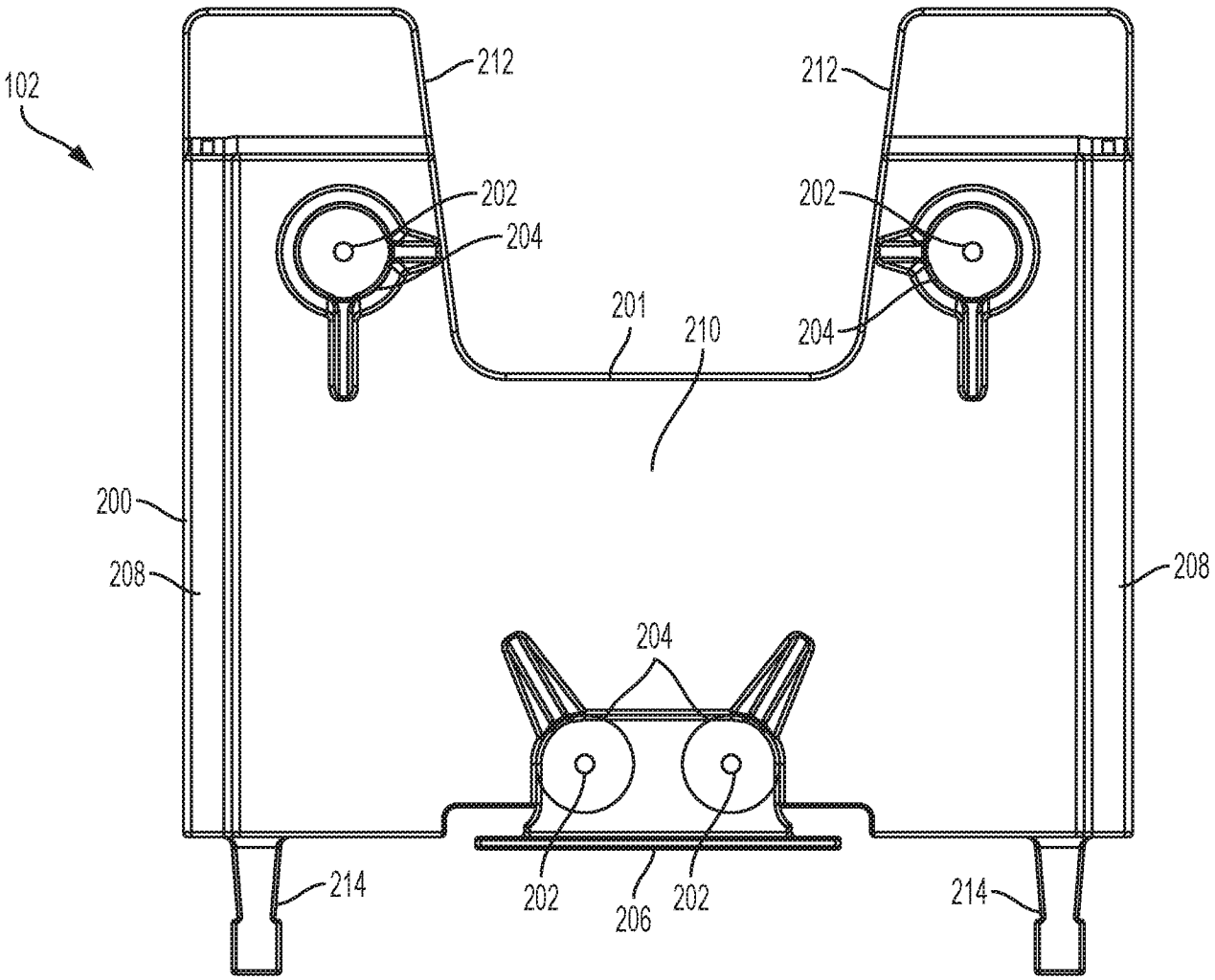
FIG. 2G is a top view of the bracket of FIG. 2A.
Figure 2H:
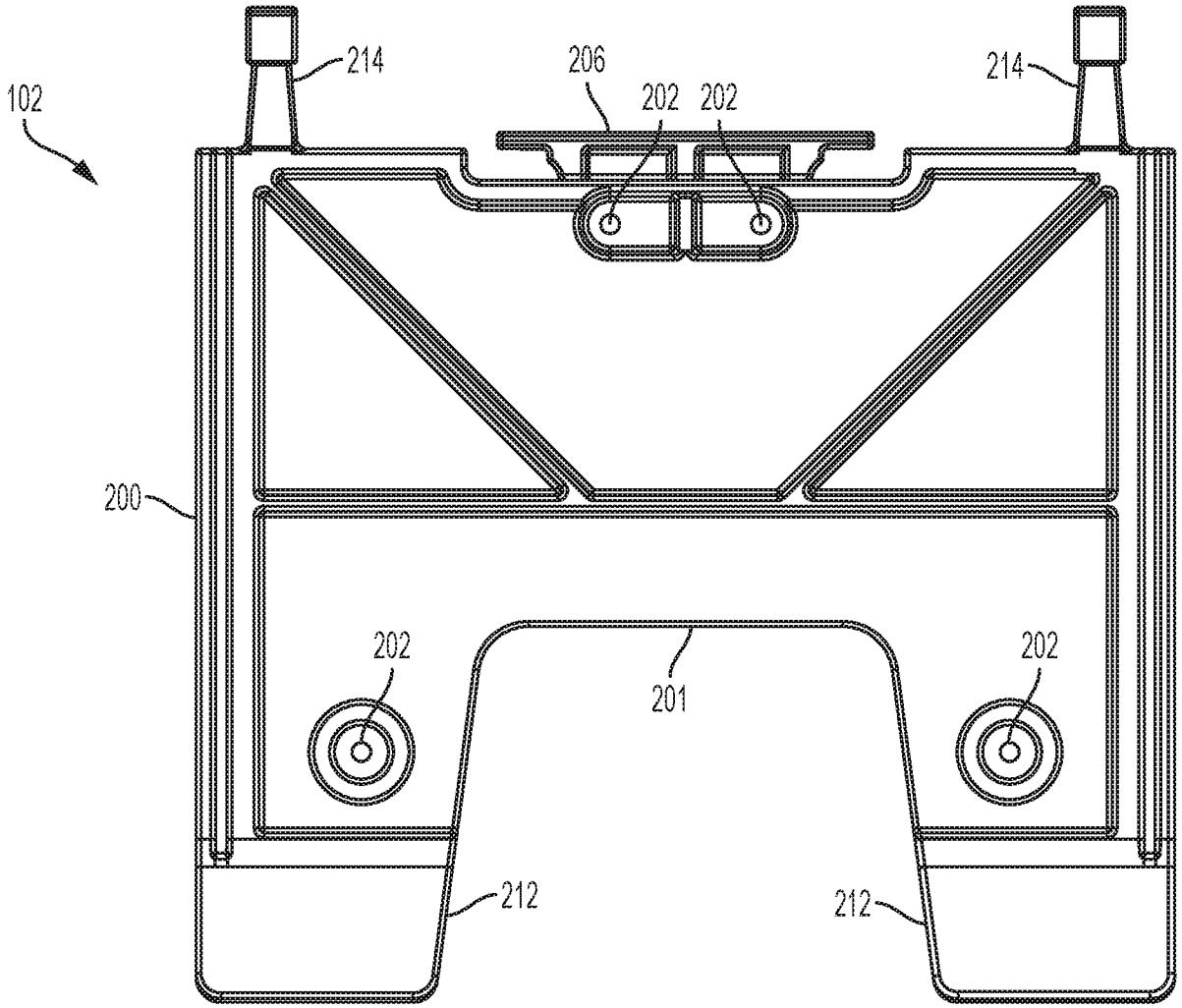
FIG. 2H is a bottom view of the bracket of FIG. 2A.
Figure 3A:
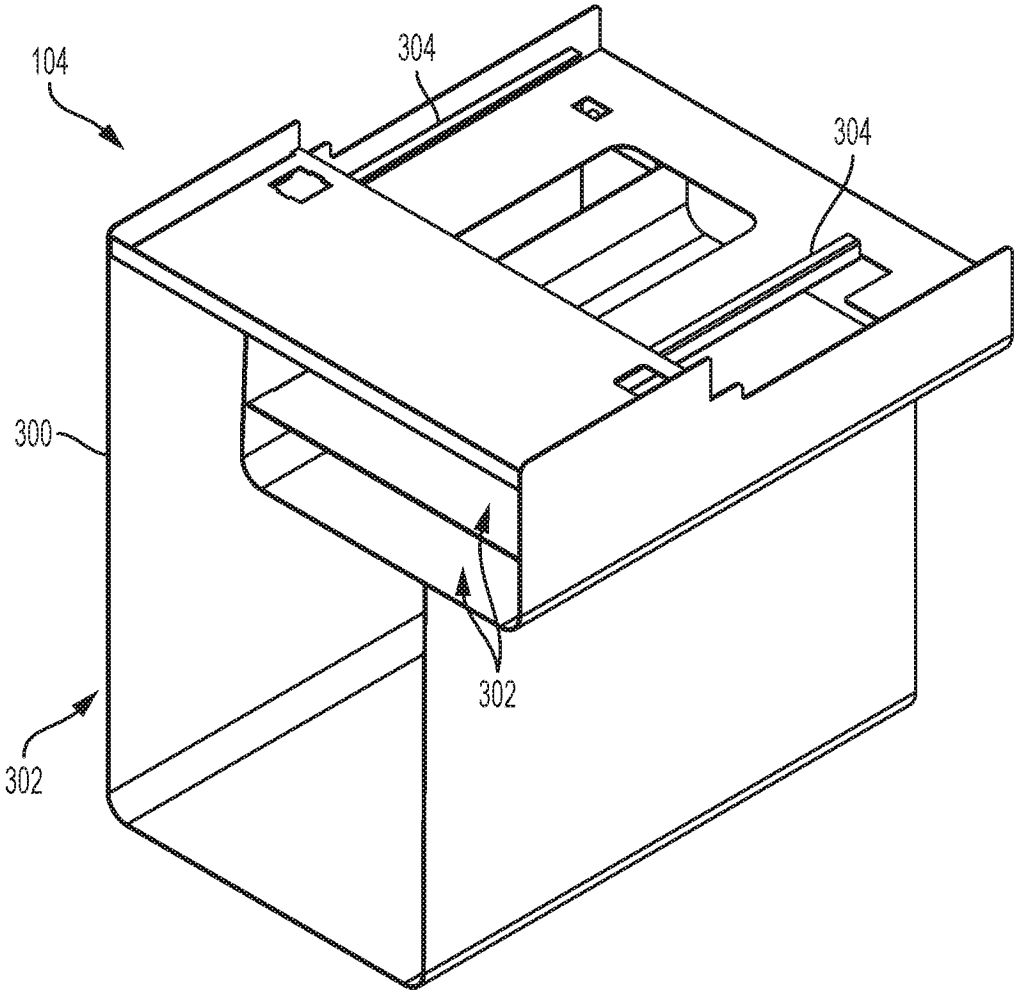
FIG. 3A is a top perspective view of a storage structure of the system of FIG. 1.
Figure 3B:
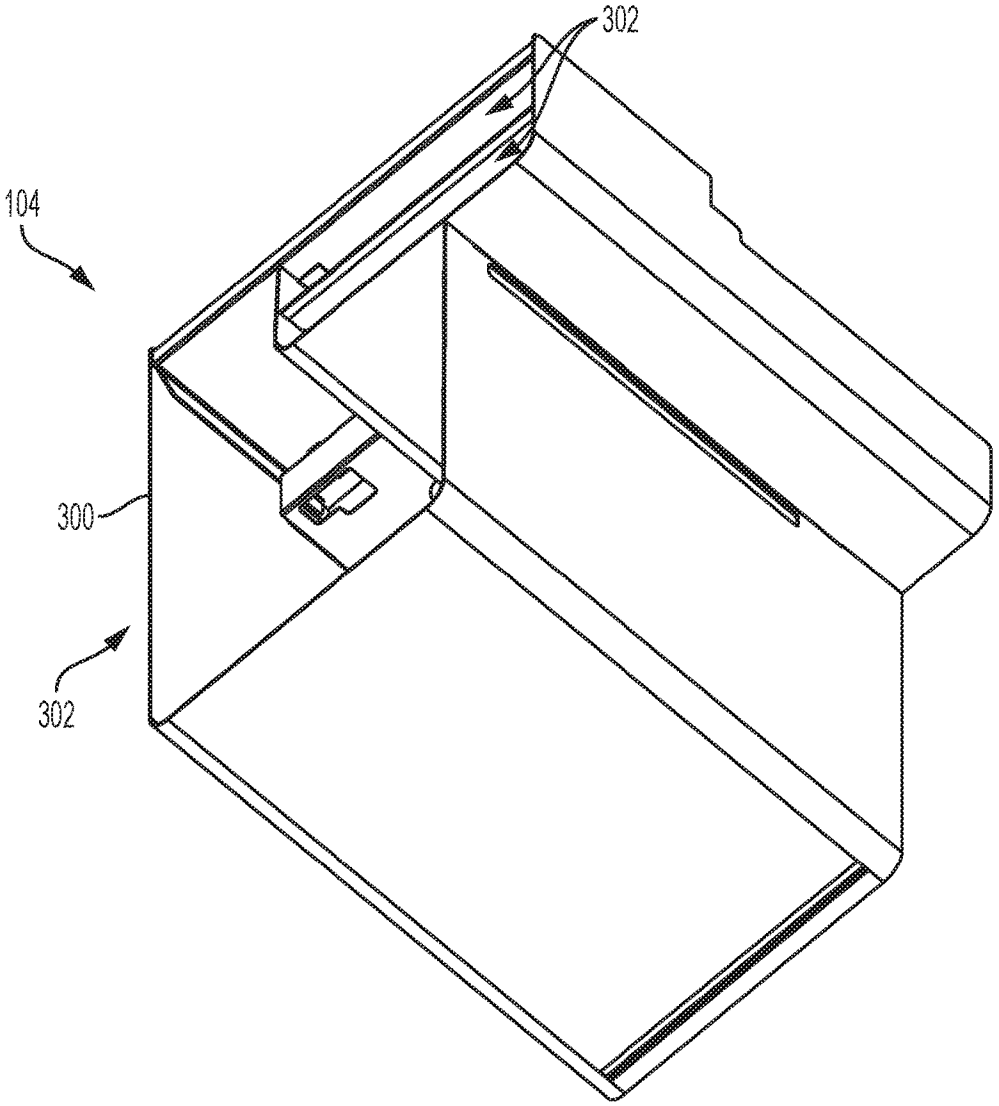
FIG. 3B is a bottom perspective view of the storage structure of FIG. 3A.
Figure 3C:
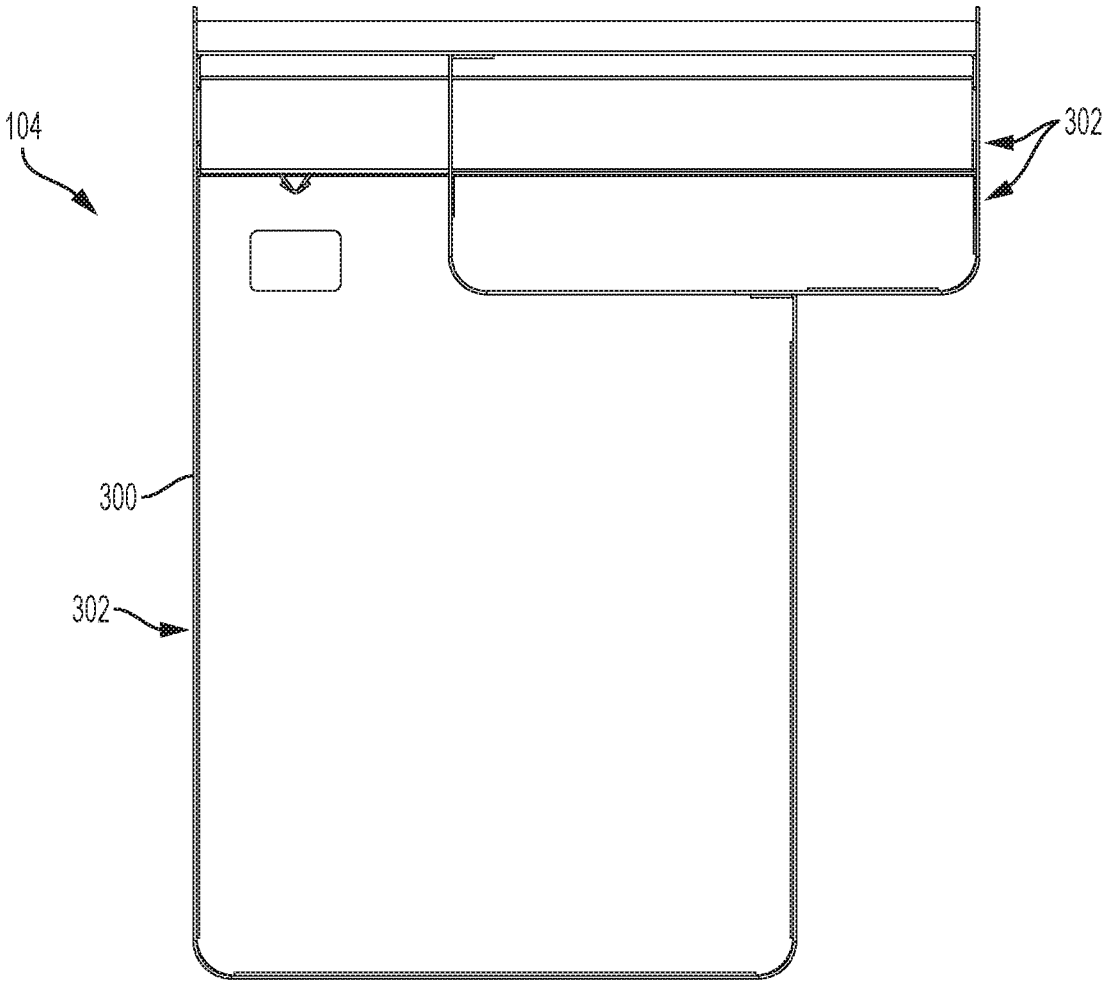
FIG. 3C is a front view of the storage structure of FIG. 3A.
Figure 3D:
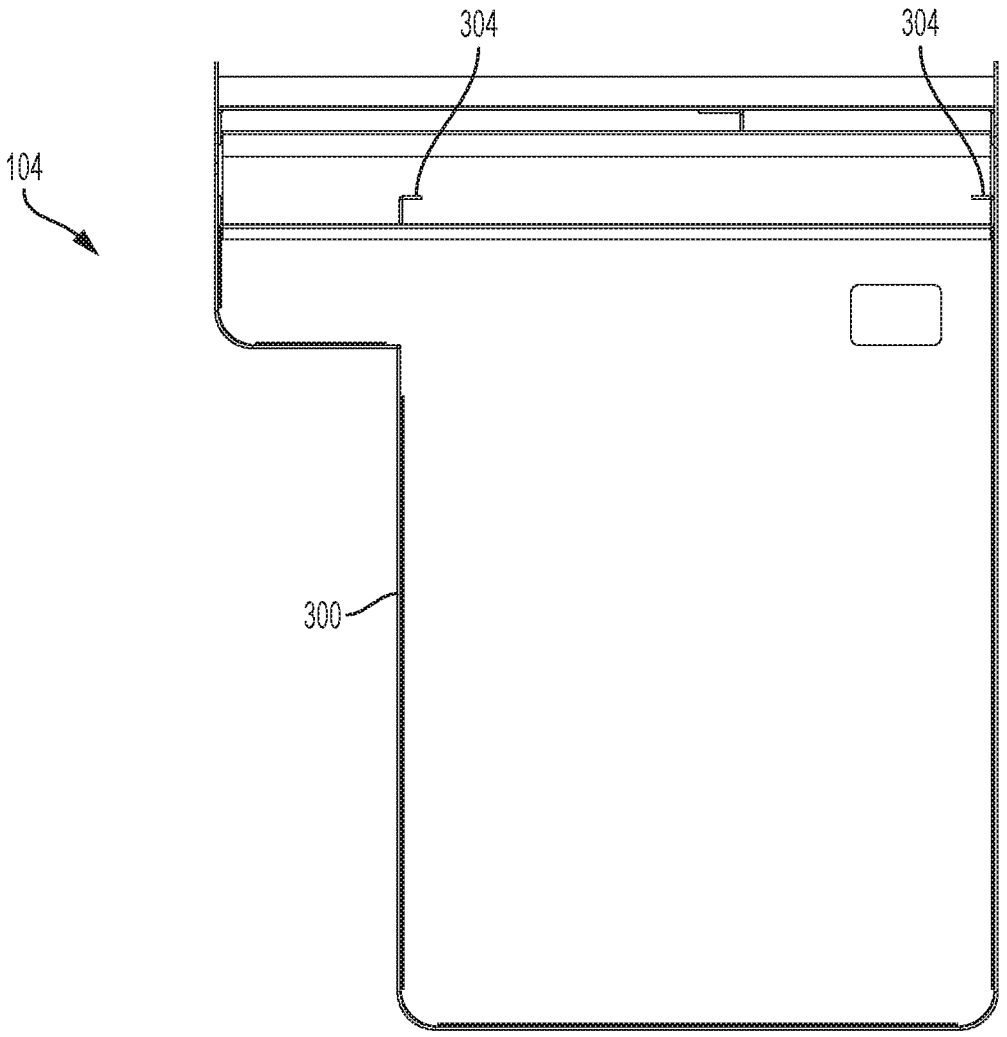
FIG. 3D is a rear view of the storage structure of FIG. 3A.
Figure 3E:
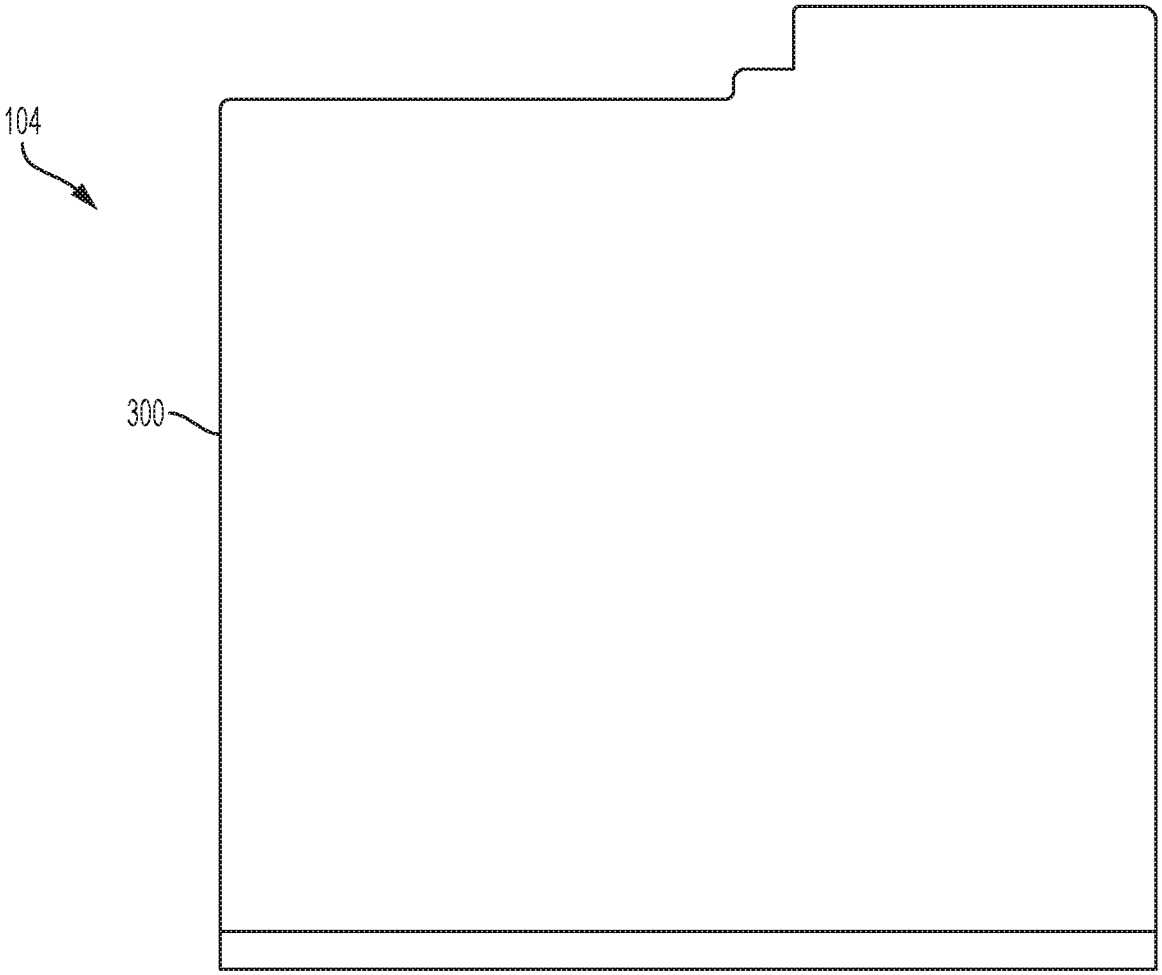
FIG. 3E is a left view of the storage structure of FIG. 3A.
Figure 3F:
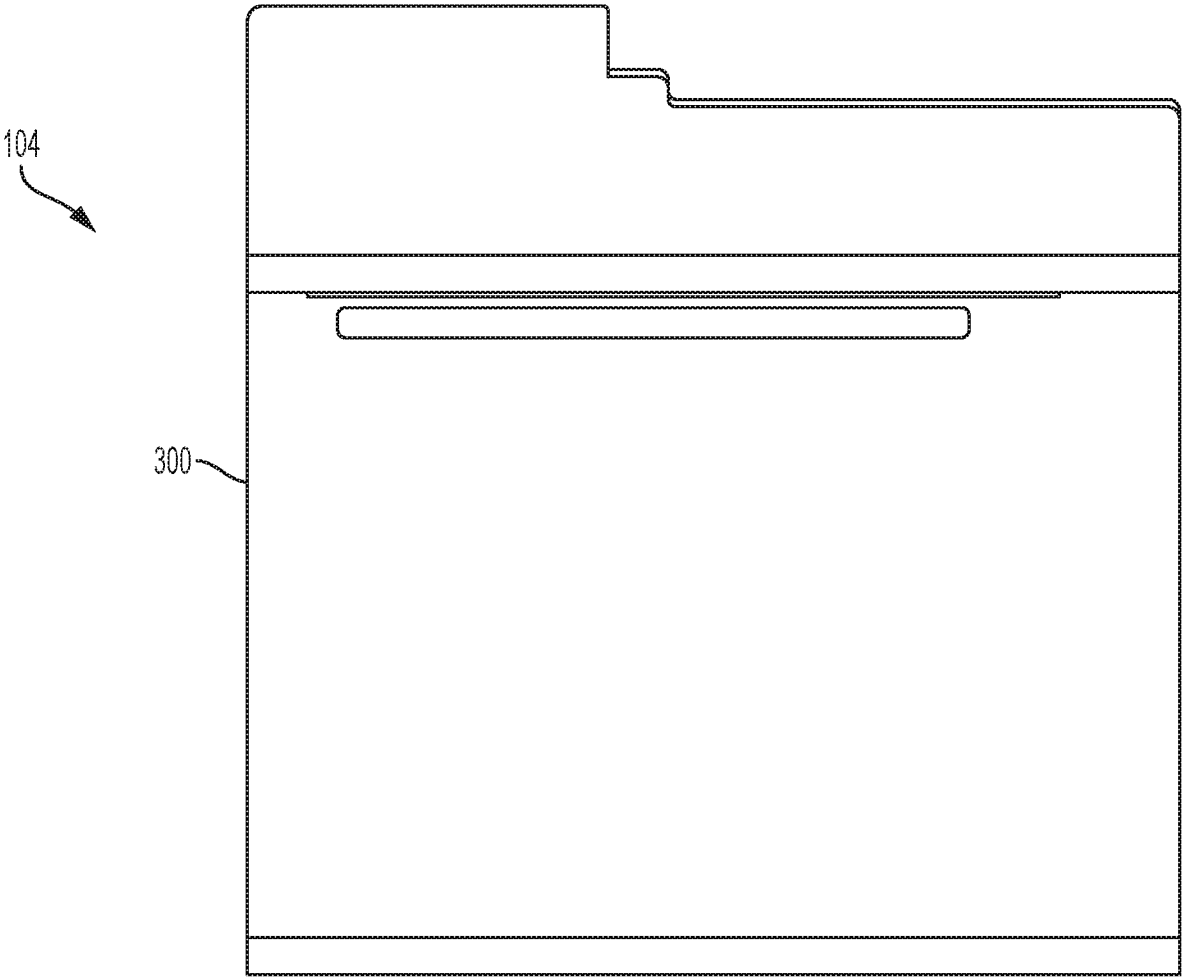
FIG. 3F is a right view of the storage structure of FIG. 3A.
Figure 3G:
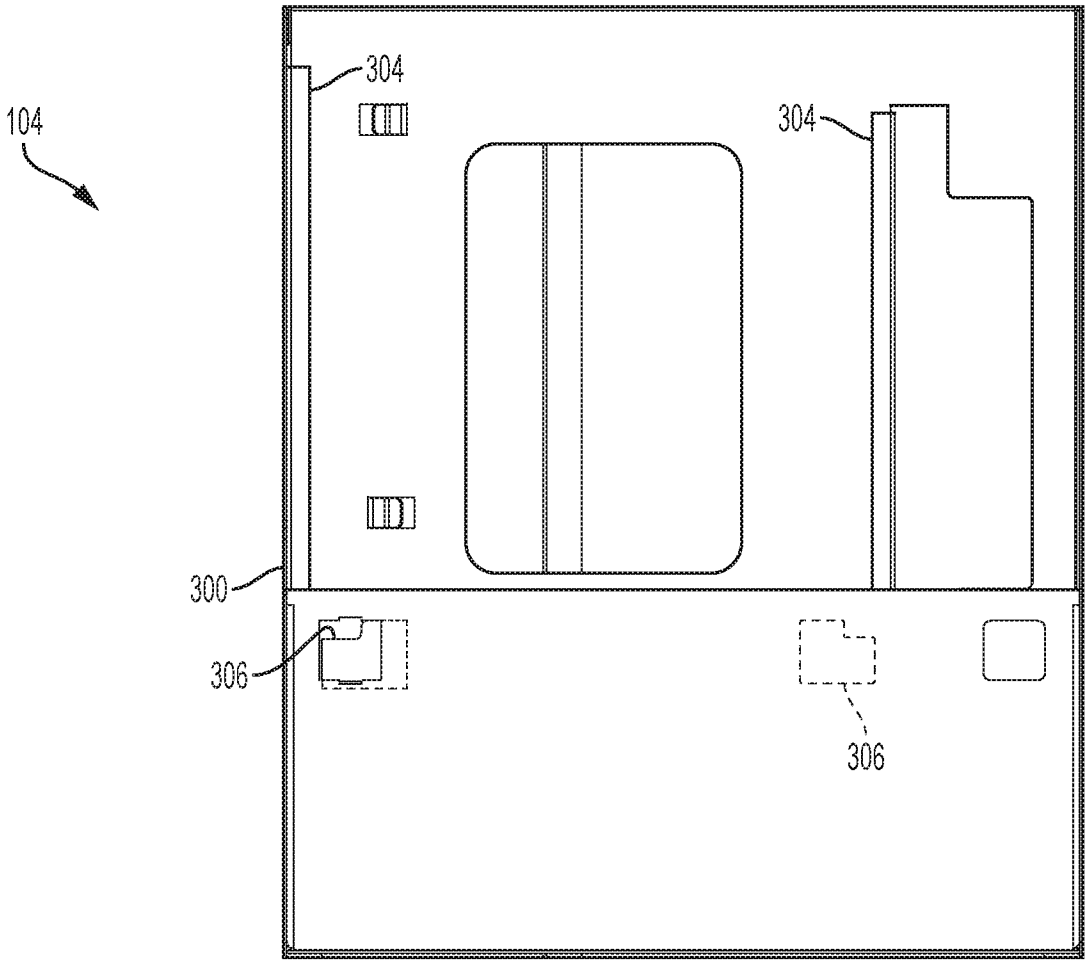
FIG. 3G is a top view of the storage structure of FIG. 3A.
Figure 3H:
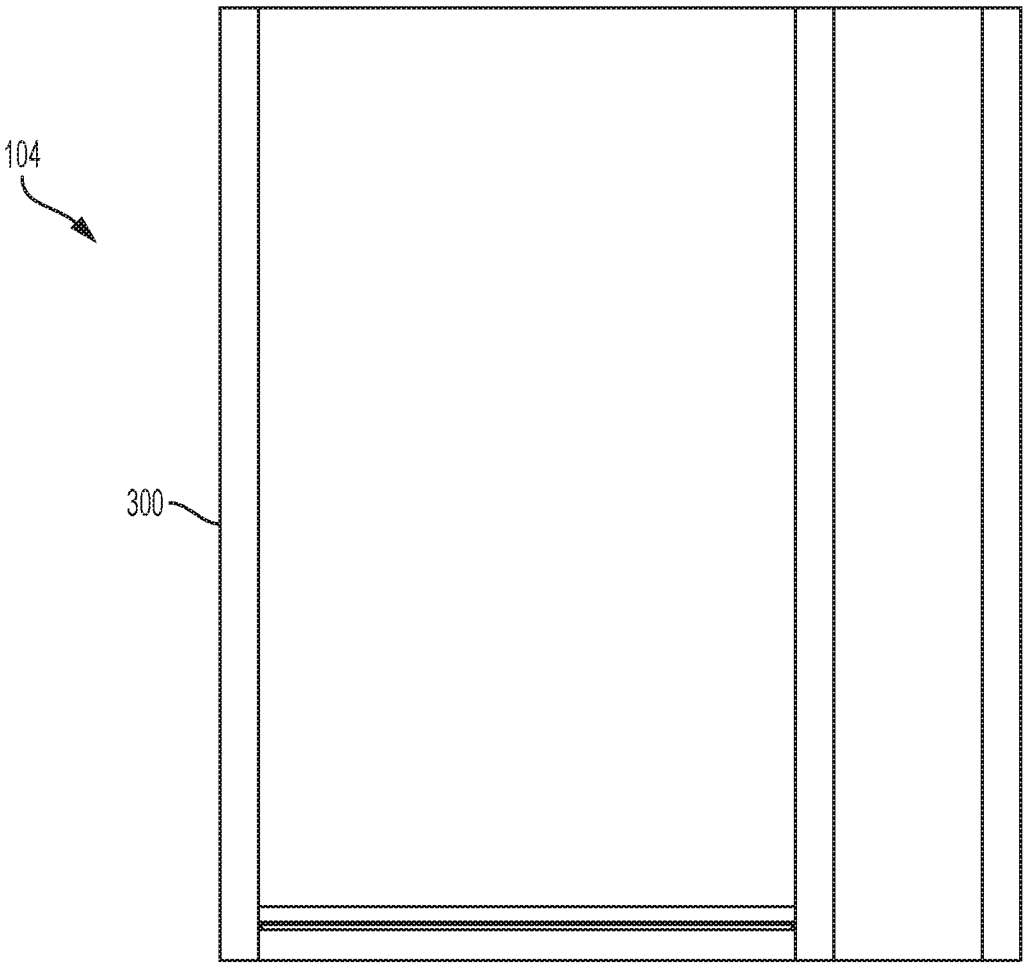
FIG. 3H is a bottom view of the storage structure of FIG. 3A.
Figure 4:
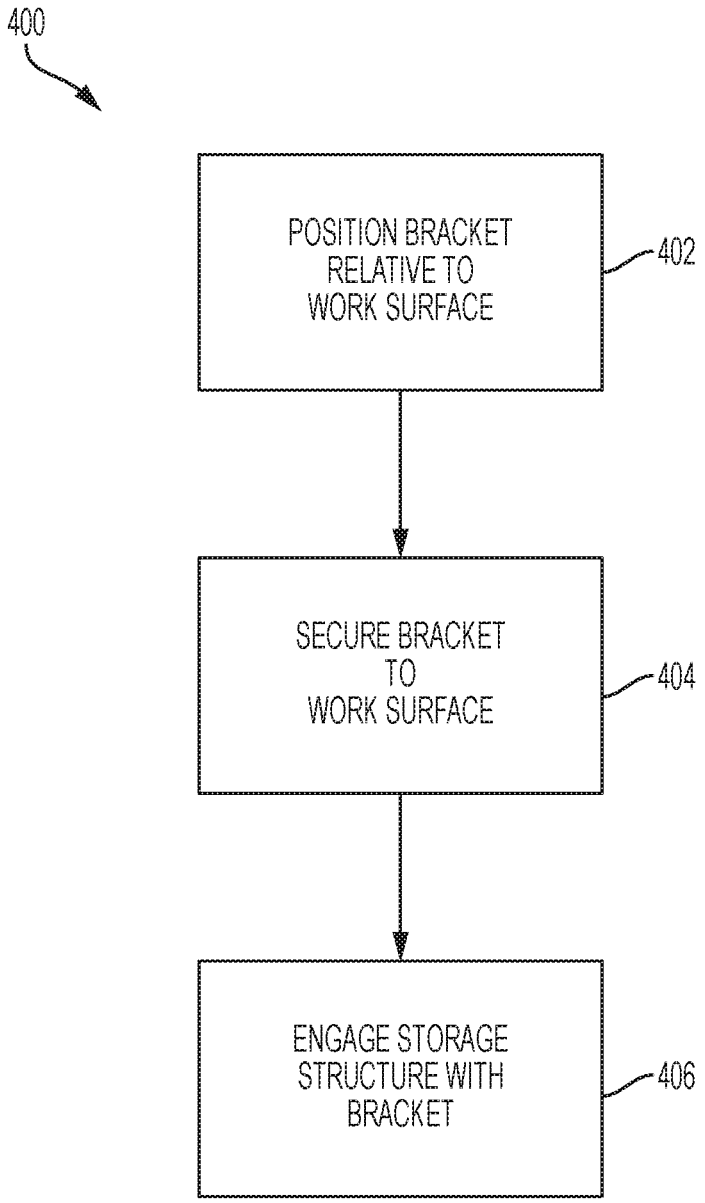
FIG. 4 is a flowchart of a method for mounting the system of FIG. 1 to an underside of a work surface of an office furniture structure, according to an embodiment of the present disclosure.

It should be understood that the drawings are intended facilitate understanding of exemplary embodiments of the present invention are not necessarily to scale.

DETAILED DESCRIPTION

The following description refers to the accompanying drawings which show specific embodiments. Although specific embodiments are shown and described, it is to be understood that additional or alternative features are employed in other embodiments. The following detailed description is not to be taken in a limiting sense, and the scope of the claimed invention is defined by the appended claims and their equivalents.

It should be understood that like reference numerals are intended to identify the same structural components, elements, portions, or surfaces consistently throughout the several drawing figures, as such components, elements, portions, or surfaces may be further described or explained by the entire written specification, of which this detailed description is an integral part. Unless otherwise indicated, the drawings are intended to be read (for example, cross-hatching, arrangement of parts, proportion, degree, etc.) together with the specification, and are to be considered a portion of the written description.

Generally, systems and brackets according to embodiments of the present disclosure facilitate mounting storage structures, such as filing cabinets and cubbies, to the underside of work surfaces of office furniture structures, such as desks and tables. Brackets according to embodiments of the present disclosure are first secured to the underside of office work surfaces, for example, via fasteners, such as screws or the like, and storage structures are subsequently mounted to the brackets. Such a mounting process is relatively easy compared to, for example, lifting entire storage structures, or the majority thereof, while simultaneously securing them to the underside of office work surfaces.

FIG. 1 illustrates an exemplary system 100 for mounting to an underside 10 of a work surface 12 of an office furniture structure 14, according to an embodiment of the present disclosure. The system 100 generally includes a bracket 102 (shown in hidden lines) that is secured to the underside 10 of the work surface 12 and a storage structure 104 that is secured to the bracket 102.

FIGS. 2A-2H illustrate the bracket 102 of the system 100. The bracket 102 includes a body 200 that is monolithically formed of one or more materials, such as plastics, metals, composites, and the like. In some embodiments, the body 200 may be non-monolithically formed, or formed with a multiple-component structure. Generally, the bracket 102 may have a shape that facilitates avoiding contact with some features of the office furniture structure 14. For example and as shown in the figures, the bracket 102 has a general H-shape, as viewed from above and below. Stated another way, the bracket 102 includes a concave edge 201 to avoid contact with features of the office furniture structure 14 (for example, height adjustment components (not shown) of the office furniture structure 14).

The bracket 102 includes one or more securing features for securing the bracket 102 to the underside 10 of the work surface 12. For example, securing features may be through holes 202 and bosses 204 (as a specific example, four through holes 202 and bosses 204) that receive mechanical fasteners (for example, screws; not shown) to secure the bracket 102 to the underside 10 of the office work surface 12. In some embodiments, securing features may take other forms.

The bracket 102 includes one or more locating features that engage an edge of the work surface 12 (for example, the front edge 16 of the work surface 12; see FIG. 1) to facilitate appropriate positioning the bracket 102, and the storage structure 104, relative to the work surface 12. A locating feature may be, for example, a vertically-extending panel 206 coupled to some of the bosses 204. The panel 206 engages an edge of the work surface 12 to facilitate appropriate positioning the bracket 102, and the storage structure 104, relative to the work surface 12. In some embodiments, locating features may take other forms.

The bracket 102 includes one or more installation features that are configured to engage one or more installation features of the storage structure 104. The installation features facilitate coupling the storage structure 104 to the bracket 102 and, as a result, the work surface 12. For example, the installation features of the bracket 102 may be two channels 208 defined on opposite sides of the bracket 102, and the installation features of the storage structure 104 may be two inverted L-shaped rails 304 near the top of the storage structure 104 (shown elsewhere and described in further detail below) that are slidably received by the channels 208. As another example, the bracket 102 may lack any channels 208, and an upper surface 210 of the bracket 102 (that is, the surface from which the bosses 204 extend) may slidably receive the inverted L-shaped rails 304. In some embodiments, installation features may take other forms.

The bracket 102 includes one or more restraining features that inhibit the storage structure 104, after being mounted to the bracket 102, from being detached from the bracket 102. Some of the restraining features of the bracket 102 may engage restraining features of the storage structure 104. For example, restraining features may be legs 212 on opposite sides of the bracket 102 that engage and are displaced by the storage structure 104. As such, the legs 212 apply forces against the storage structure 104 and thereby inhibit the storage structure 104 from being detached from the bracket 102. As another example, restraining features may be arms 214 on opposite sides of the bracket 102 that are received in and engage edges of apertures 306 formed on the storage structure 104 (shown elsewhere and described in further detail below). In some embodiments, restraining features may take other forms.

FIGS. 3A-3H illustrate the storage structure 104 of the system 100. The storage structure 104 includes a body 300 that is formed of a plurality of panels (for example, bent sheet metal panels). In some embodiments, the body 300 of the storage structure 104 may be formed in other manners.

The storage structure 104 includes one or more storage chambers. For example, the storage structure 104 may include three storage chambers 302. As shown in the figures, the storage chambers 302 may each have one or more open sides. In some embodiments, any of the storage chambers 302 may include slidable drawers (not shown) or pivotable doors (not shown) that facilitate selectively closing the chambers 302.

Referring again briefly to FIG. 1, a portion of the storage structure 104 may be disposed forwardly of the work surface 12 of the office furniture structure 14. A portion of the storage structure 104 may be disposed in a common plane, in a height direction above the ground, with the work surface 12 of the office furniture structure 14.

Referring again to FIGS. 3A-3H and as briefly described above, the storage structure 104 includes one or more installation features that engage the installation feature(s) of the bracket 102. For example, the installation features of the storage structure 104 may be two inverted L-shaped rails 304 near the top of the storage structure 104 that engage the two channels 208 of the bracket 102. In some embodiments, installation features may take other forms.

As described briefly above, the storage structure 104 includes one or more restraining features that inhibit the storage structure 104, after being mounted to the bracket 102, from being detached from the bracket 102. For example, the restraining features of the storage structure 104 may be the edges of apertures 306 (see FIG. 3G) that engage arms 214 of the bracket 102. In some embodiments, restraining features may take other forms.

Figure 5A:
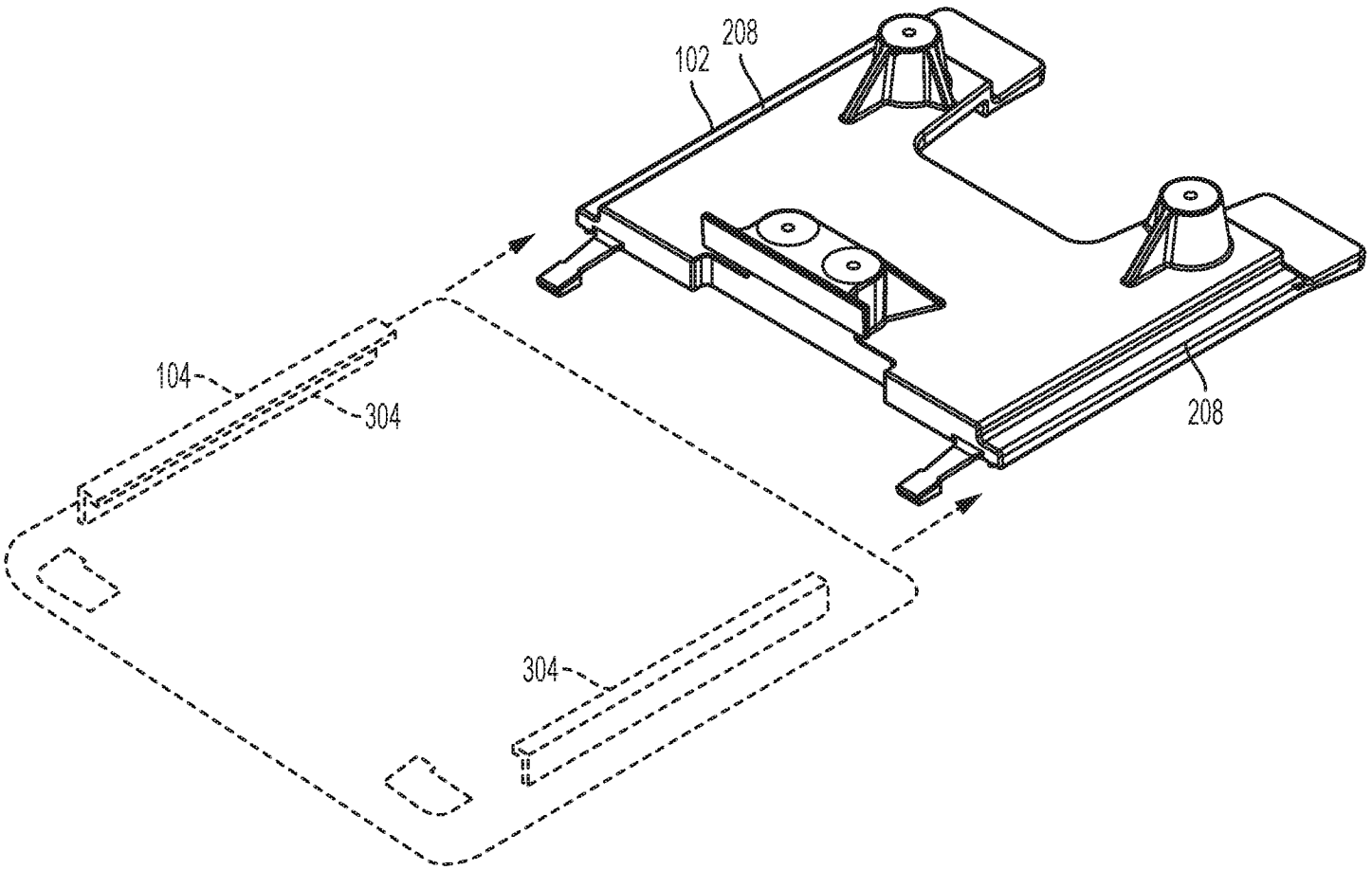
FIG. 5A is a top perspective view of the storage structure of FIG. 3A being coupled to the bracket of FIG. 2A.
Figure 5B:
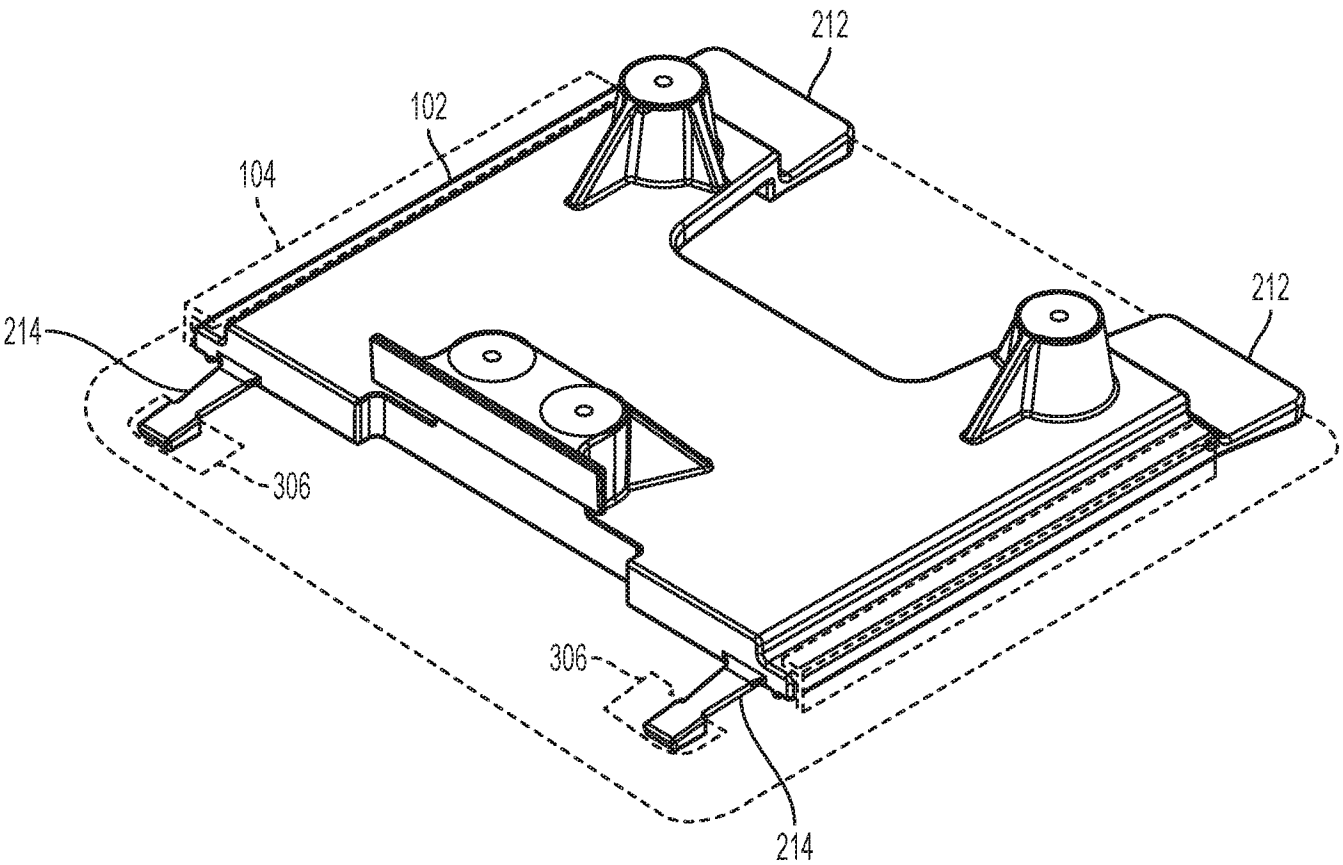
FIG. 5B is another top perspective view of the storage structure of FIG. 3A being coupled to the bracket of FIG. 2A.
Figure 5C:
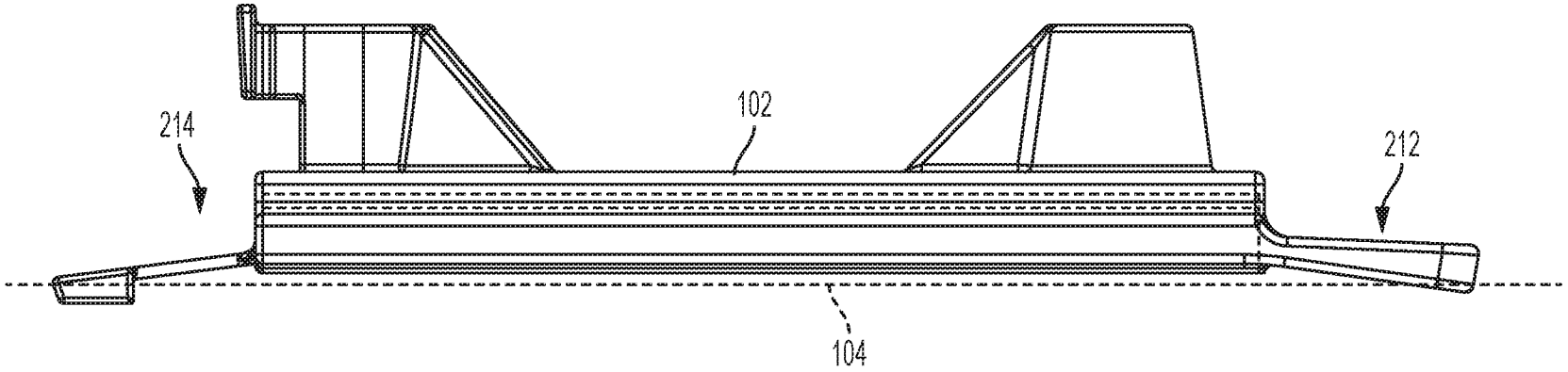
FIG. 5C is a side view of the storage structure of FIG. 3A being coupled to the bracket of FIG. 2A.

FIGS. 4 and 5A-5C illustrate a method 400 for mounting the bracket 102 and a storage structure 104 to the underside 10 of a work surface 12 according to an embodiment of the present disclosure. In FIGS. 5A-5C, the work surface 12 is not shown and only several features of the storage structure 104 are shown in hidden lines to illustrate interaction of features of the bracket 102 and the storage structure 104. At block 402, the bracket 102 is positioned such that the bosses 204 engage the underside 10 of the work surface 12 and the vertically-extending panel 206 engages the front edge 16 of the work surface 12. While in such a position, at block 404 the bracket 102 is secured to the underside 10 of the work surface 12 by passing screws through the through holes 202 and bosses 204. Next, at block 406 and as shown in FIG. 5A, the storage structure 104 is engaged with and translated relative to the bracket 102 such that the inverted L-shaped rails 304 are received by and slide over the channels 208 on the bracket 102. As shown in FIGS. 5B and 5C, this causes the legs 212 to engage the storage structure 104 and the arms 214 to engage the edges of the apertures 306 on the storage structure 104, thereby inhibiting the storage structure 104 from being detached from the bracket 102.

Brackets, systems, and methods according to embodiments of the present disclosure may take various other forms. For example, the bracket 102 and the storage structure 104 may include the opposite restraining features. Various other modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A bracket for mounting a storage structure to an underside of a work surface of an office furniture structure, the bracket comprising:

at least one securing feature configured to secure the bracket to the underside of the work surface of the office furniture structure;

at least one installation feature configured to couple the bracket to the storage structure, the at least one installation feature comprising a channel configured to slidably receive a rail of the storage structure; and at least one restraining feature configured to engage the storage structure and inhibit the storage structure from being detached from the bracket, the at least one restraining feature comprising an arm configured to be received in an aperture to inhibit the storage structure from being detached from the bracket, wherein the at least one restraining feature further comprises a leg that is configured to engage and be displaced by the storage structure to inhibit the storage structure from being detached from the bracket.

2. The bracket of claim 1, wherein the channel is first channel and the rail is a first rail, and wherein the at least one installation feature further comprises a second channel configured to slidably receive a second rail of the storage structure.

3. The bracket of claim 1, wherein the at least one securing feature comprises a through hole configured to receive a mechanical fastener.

4. The bracket of claim 1, further comprising at least one locating feature configured to engage an edge of the work surface.

5. A system for mounting to an underside of a work surface of an office furniture structure, the system comprising:

a storage structure, comprising:

at least one storage chamber;

at least one installation feature coupled to the at least one storage chamber, the at least one installation feature comprising a rail;

a bracket, comprising:

at least one securing feature configured to secure the bracket to the underside of the work surface of the office furniture structure; and at least one installation feature configured to couple to the at least one installation feature of the storage structure, the at least one installation feature of the bracket comprising a channel configured to slidably receive the rail of the storage structure; and wherein at least one of the storage structure and the bracket comprises at least one restraining feature configured to engage the other of the storage structure and the bracket and inhibit the storage structure from being detached from the bracket, the at least one restraining feature comprising a leg that is configured to engage and be displaced by the other of the storage structure and the bracket to inhibit the storage structure from being detached from the bracket.

6. The system of claim 5, wherein the storage structure further comprises an aperture, and the at least one restraining feature further comprises an arm of the bracket, the arm being configured to be received in the aperture to inhibit the storage structure from being detached from the bracket.

7. The system of claim 6, wherein the bracket comprises the leg.

8. A method for mounting a storage structure to an underside of a work surface of an office furniture structure, the method comprising:

securing a bracket to the underside of the work surface of the office furniture structure, the bracket comprising at least one restraining feature comprising a leg, and the bracket comprising at least one installation feature comprising a channel; and engaging the storage structure with the bracket and translating the storage structure relative to the bracket such that the channel slidably receives a rail of the storage structure and the leg engages and is displaced by the storage structure and inhibits the storage structure from being detached from the bracket.

9. The method of claim 8, wherein the storage structure includes at least one aperture, and the at least one restraining feature further comprises an arm that is received in the at least one aperture to inhibit the storage structure from being detached from the bracket.

10. The method of claim 8, wherein the bracket further comprises at least one locating feature, and wherein securing the bracket to the underside of the work surface of the office furniture structure comprises engaging the at least one locating feature with an edge of the work surface.

11. The system of claim 5, wherein the bracket comprises the leg.

12. The system of claim 5, wherein the at least one securing feature comprises a through hole configured to receive a mechanical fastener.

13. The system of claim 5, wherein the bracket comprises at least one locating feature configured to engage an edge of the work surface.

14. The system of claim 5, wherein the channel is first channel and the rail is a first rail, wherein the at least one installation feature of the storage structure further comprises a second rail, and wherein the at least one installation feature of the bracket further comprises a second channel configured to slidably receive the second rail.

* * * * *